United States Patent [19]

Wittman et al.

[11] Patent Number: 4,601,401

[45] Date of Patent: Jul. 22, 1986

[54] CENTERING ARRANGEMENT FOR REDECKING OF CRANE UPPER

[75] Inventors: Leroy L. Wittman, Marion; David W. Olsen, Palo, both of Iowa

[73] Assignee: FMC Corporation, Chicago, Ill.

[21] Appl. No.: 731,755

[22] Filed: May 7, 1985

Related U.S. Application Data

[63] Continuation of Ser. No. 487,640, Apr. 22, 1983, abandoned.

[51] Int. Cl.[4] ..... B66C 23/36

[52] U.S. Cl. ..... 212/180; 212/189

[58] Field of Search ..... 212/175–182, 212/189, 245–249, 253; 104/35, 45–47; 105/215 C; 280/763.1

[56] References Cited

U.S. PATENT DOCUMENTS

| | | | |
|---|---|---|---|
| 904,335 | 11/1908 | Lawry | 104/47 |
| 3,219,362 | 11/1965 | Epstein | 280/763.1 |
| 3,545,628 | 12/1970 | Dechantsreiter | 104/47 |
| 3,762,337 | 10/1973 | McKeon et al. | 105/215 C |
| 4,273,244 | 6/1981 | Jensen et al. | 212/181 |
| 4,363,412 | 12/1982 | Patel | 212/178 |
| 4,394,911 | 7/1983 | Wittman et al. | 212/253 |

FOREIGN PATENT DOCUMENTS

| | | | |
|---|---|---|---|
| 1241962 | 6/1967 | Fed. Rep. of Germany | 212/189 |
| 2037243 | 7/1980 | United Kingdom | 212/180 |

*Primary Examiner*—Trygve M. Blix
*Assistant Examiner*—Stephen P. Avila
*Attorney, Agent, or Firm*—Ronald C. Kamp; Richard B. Megley

[57] ABSTRACT

A centering device for aligning those portions of the swing mechanism, e.g. the swing pinion on the upper with the ring gear on the carrier, to permit the redecking of a crane upper on its carrier, the device including a plurality of sockets on the carrier which are engageable by frustoconical ends on a plurality of pins slidably mounted on the upper. A latch holds the pins in an extended position so that the retraction of the legs supporting the upper above the carrier will cause lateral shifting as necessary to align the swing mechanism.

4 Claims, 9 Drawing Figures

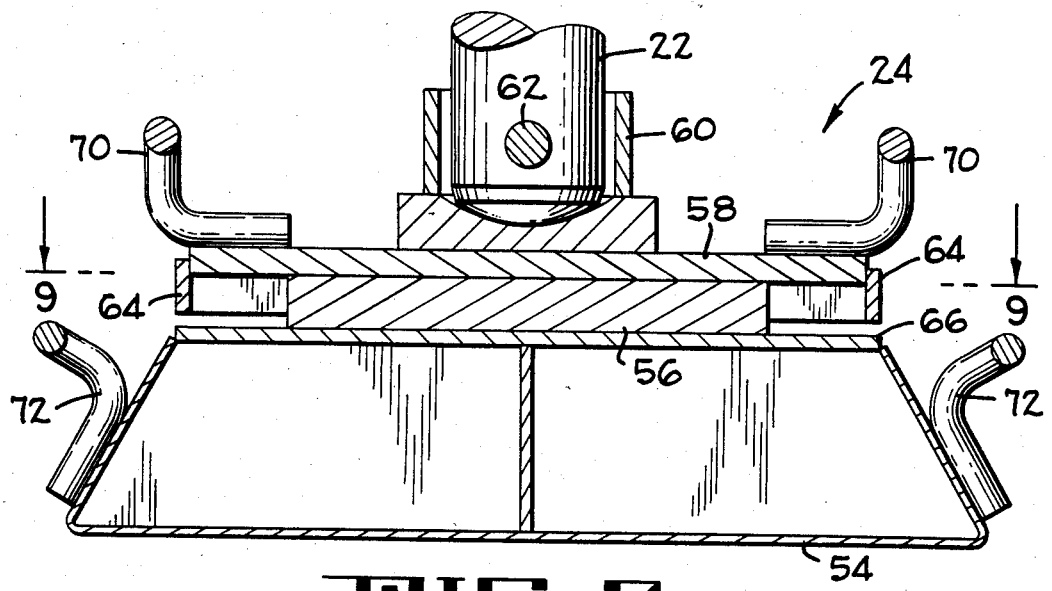
FIG_7
FIG_8
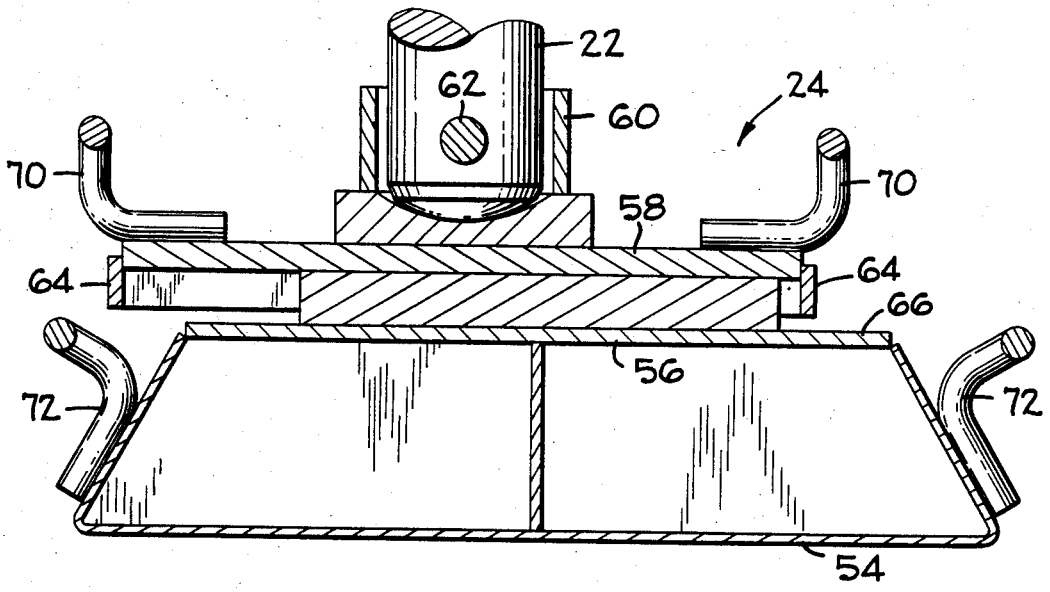
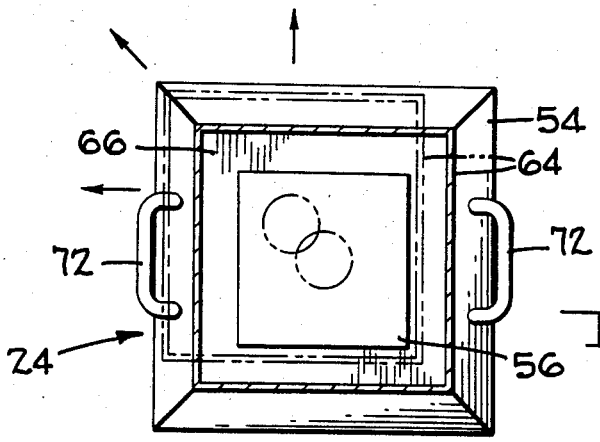
FIG_9

CENTERING ARRANGEMENT FOR REDECKING OF CRANE UPPER

This application is a continuation of application Ser. No. 487,640, filed 4/22/83, now abandoned.

This invention relates to an arrangement for centering the upper relative to the lower or carrier of separable cranes.

In the drawings:

FIG. 7 is a cross-sectional view of the float taken on line 7—7 of FIG. 1;

FIG. 8 is a view of the float in FIG. 7 showing the lateral shifting therein during centering; and FIG. 9 is a cross-sectional view taken on line 9—9 of FIG. 7.

Figure 1:
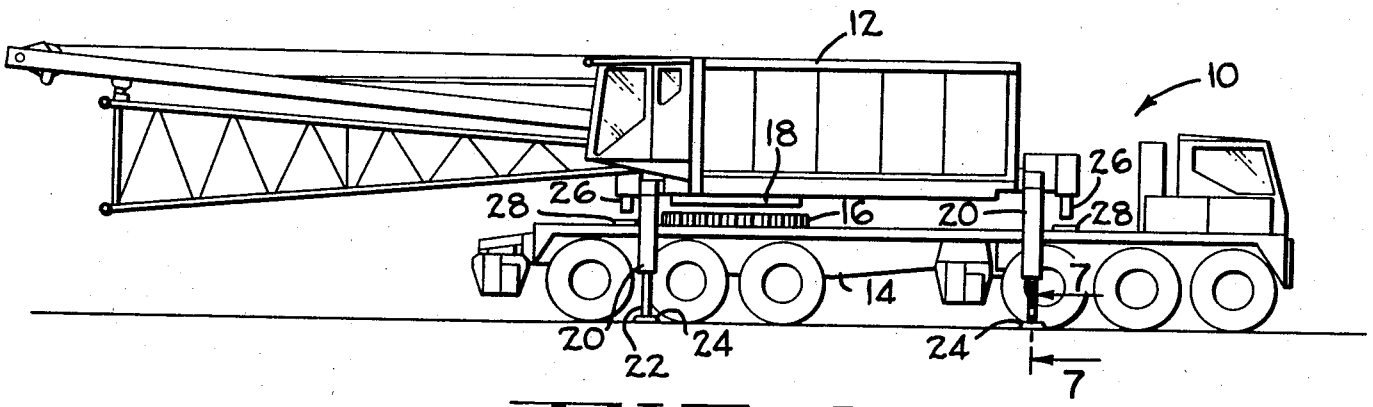
FIG. 1 is a side elevational view of a crane, shown with the upper undecked, incorporating the present invention.
Figure 2:
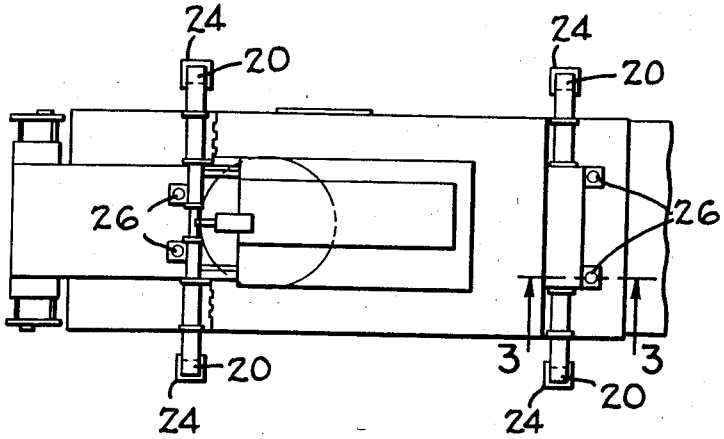
FIG. 2 is a top plan view of the crane in FIG. 1 with portions thereof broken away and eliminated.

Referring to FIGS. 1 and 2, a crane, indicated generally at 10, includes an upper 12 which is rotatably mounted on a lower or carrier 14 by means of a turntable bearing 16. The turntable bearing is releasably secured to a ring 18 secured to the upper with a locking ring expandable to interlock the bearing 16 and ring 18, and retractable to release the bearing from the ring to permit separation of the upper 12. A preferred means for such releasable attachment of ring and bearing is more fully shown and described in U.S. Pat. No. 3,923,407 issued Dec. 2, 1975 to L. B. Jensen and R. E. Thune. As will be seen therein, the ring must be aligned with the turntable bearing and the swing pinion must also be positioned for engagement with a ring gear on the outer race of the turntable bearing to permit swinging of the upper. The problem encountered with redecking of the upper on the carrier is alignment of these components within a relative close tolerance.

The upper 12 carries a plurablity of legs 20, preferrably one at each of its corners, with a double-acting hydraulic jack 22 affixed to, or otherwise incorporated into the free end of each leg 20. With the ring 18 and bearing 16 released, extension of these jacks will elevate the upper 12 above the carrier 14, as shown in FIG. 1. Retraction of these jacks will lower the upper 12 onto the carrier 14. A pontoon or float 24 is pinned to the rod end of each jack 22 to distribute the load over a relatively large area and thereby achieve acceptable ground pressures. Alignment or centering of the aforementioned components is provided by four pins 26 carried on the upper 12, two at each end thereof, and corresponding sockets 28 affixed to the carrier 14. Since all of the pins 26 and their cooperating elements are similar, a description of one will be sufficient for a complete understanding.

Figure 4:
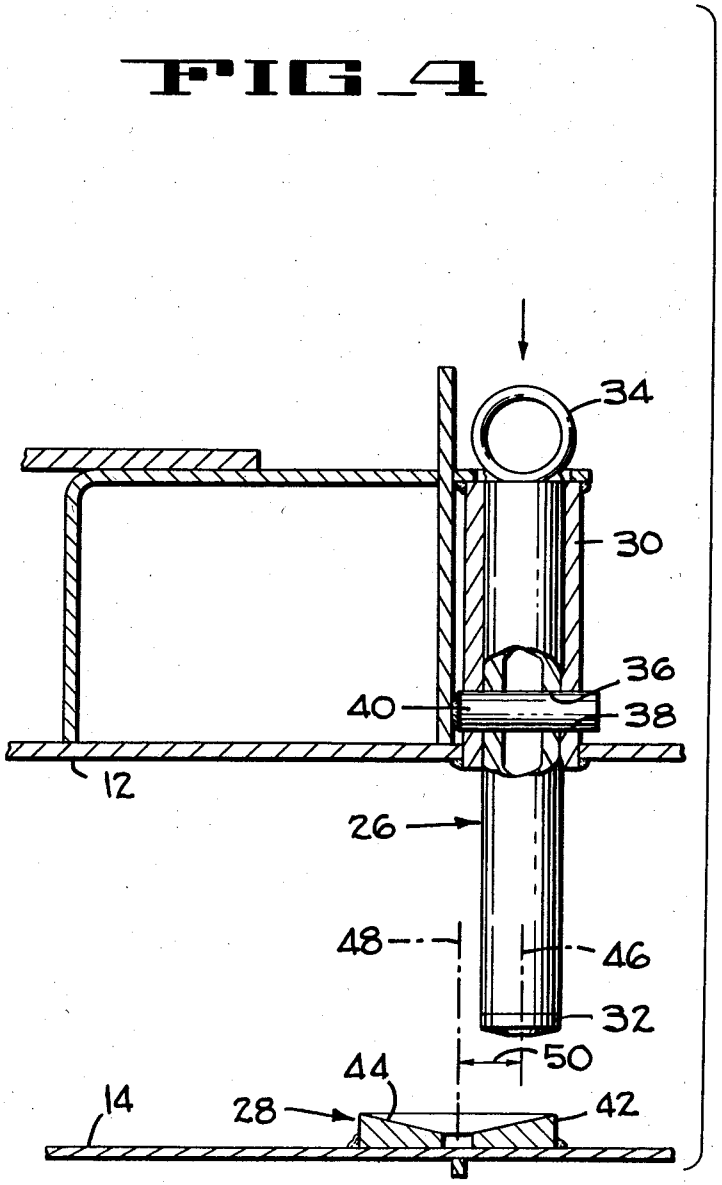
FIG. 4 is a view of the pin in FIG. 3 with the pin extended.
Figure 3:
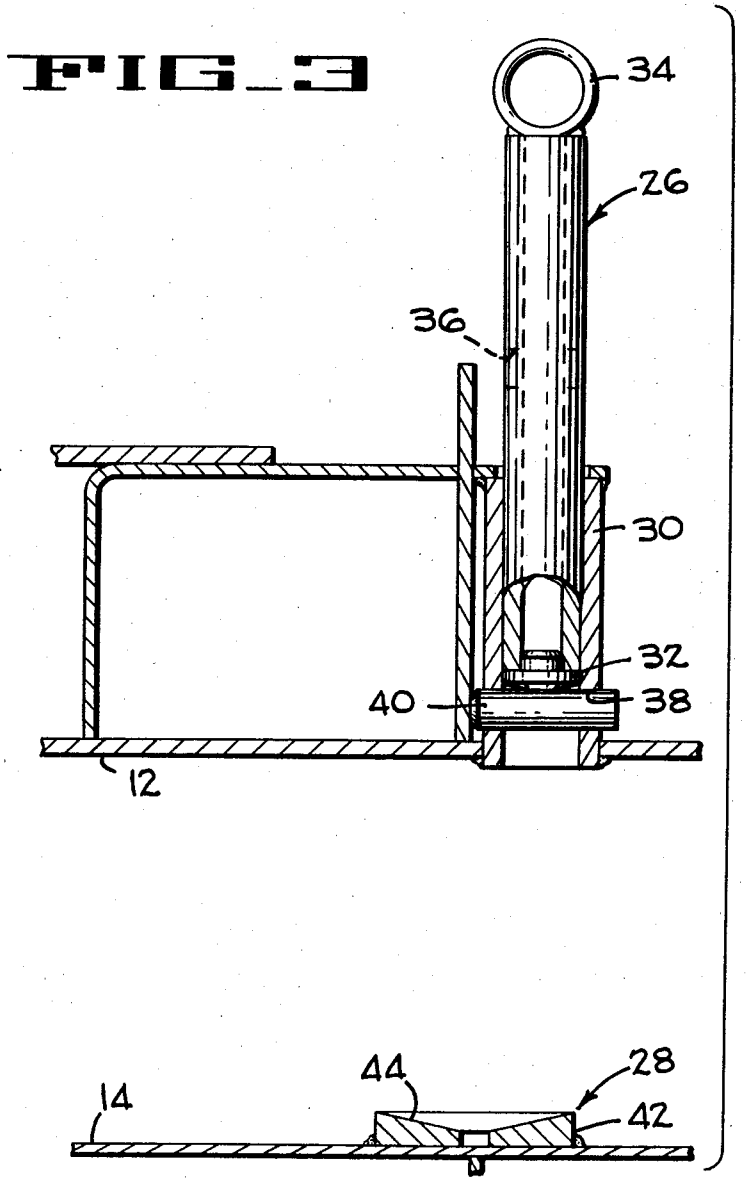
FIG. 3 is vertical section taken on line 3—3 of FIG. 2 showing one of the center pins and its mating socket with the pin retracted.

Referring now to FIGS. 3-6, the centering pin 26 is slidably mounted in a tubular member or sleeve affixed to the upper 12. The pin 26 is itself preferrably a tubular member for weight reduction and has a hardened frustroconical cap 32 affixed to its lower end. A handle 34 is secured to the upper end of the pin 26. This handle is preferrably rigid with a transverse dimension greater than the interior diameter of the sleeve 30 to preclude the pin 26 from dropping through the sleeve. A crossbore 36 is provided in the pin 26 and a similar crossbore 38 is provided in the sleeve 30. A retaining pin 40 is capable of insertion through these crossbores. The centering pin 26 is retained in an operative or stowed position by manually raising the pin 26, by means of handle 34, and inserting pin 40 through the crossbore 38 so that the cap 32 rests on the pin 40, as shown in FIG. 3. The pin 26 is retained in an operative or centering position by lowering it until the crossbores 36 and 38 are aligned and the retaining pin 40 inserted, as shown in FIG. 4.

A socket 42 having a concave surface 44, which is complementary to the conical surface of cap 32 and is circular in plan view preferrable with a diameter approximately twice that of the pin 26, is secured to the carrier 14. The angle of the conical surface 44 and the cap 32 is chosen so that the tangent of this angle is approximately equal to the coefficient of friction between the materials thereof when lubricated. Such an angle assures effective centering without imposing large side loads on the structures.

To initially position the socket 42 on the carrier 14, the upper and carrier are operatively assembled with the upper facing the rear of the carrier and aligned therewith in a fore and aft direction. With the upper and carrier so positioned, the centering pin 26 is permitted to drop into contact with the unattached socket 42. The position of the socket is then adjusted so that the centerlines of the pin and socket are aligned and the socket 42 is then secured to the carrier 14.

Figure 6:
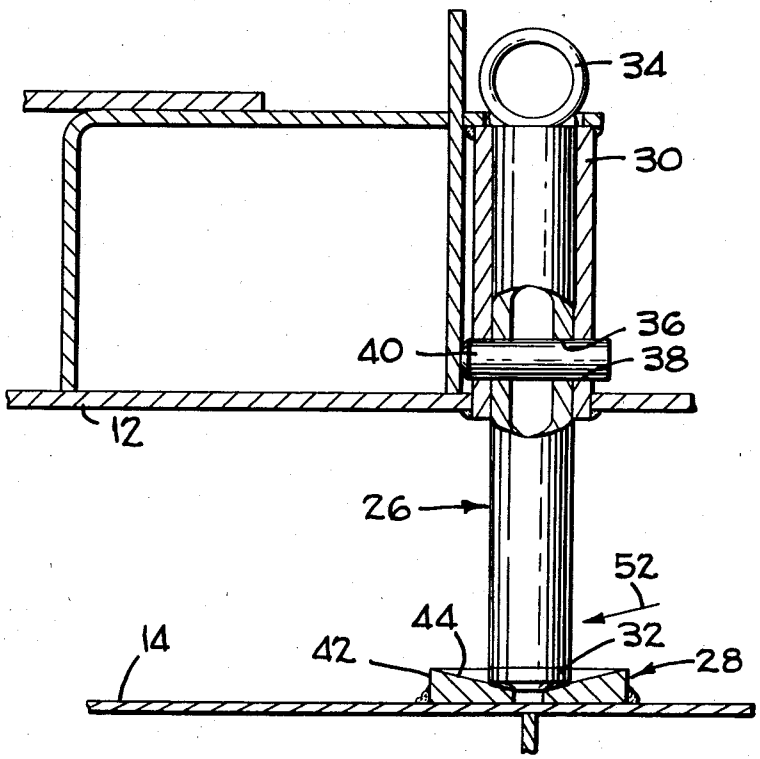
FIG. 6 is a view similar to FIG. 5 but showing the pin being laterally displaced as the upper is lowered further.
Figure 5:
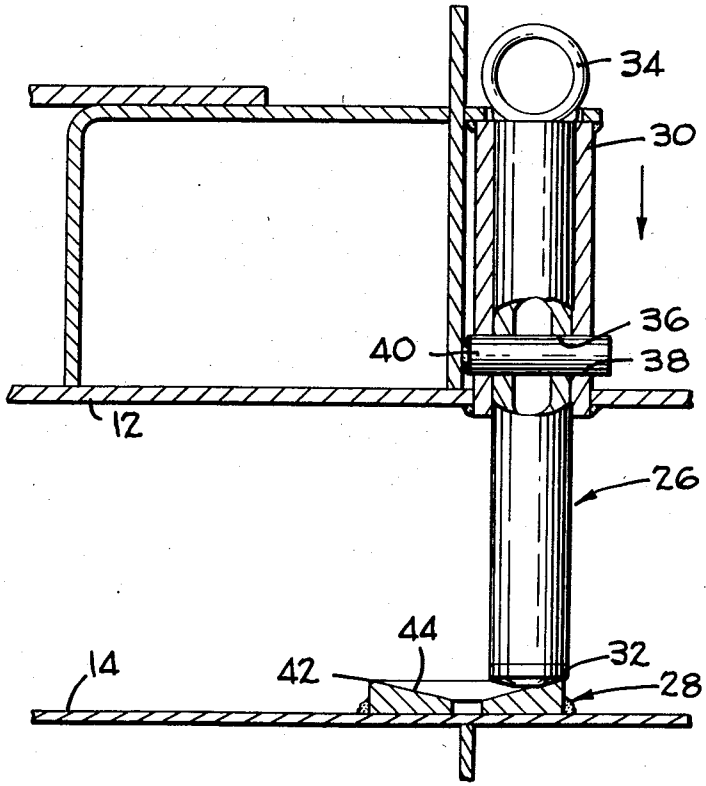
FIG. 5 is a view of the pin in FIG. 4 but with the upper having been lowered to bring the pin into contact with the socket.

The centering sequence for redecking is illustrated in FIGS. 4-6. With the upper elevated from the carrier, as shown in FIG. 1, the centering pin 26 is retained by pin 40 in its lowered or operative position. The carrier 14 is manuevered sufficiently to position the pin 26 so that at least a portion of the angled surface of the cap 32 is directly above the complementary surface 44. The centerline 46 of the pin 26 will most likely be offset from the centerline 48 of the socket 42, as indicated at 50 in FIG. 4. The jacks 22 are then slowly contracted, lowering the upper 12 and causing the pin 26 to contact the socket 42, as shown in FIG. 5. A further contraction of these jacks will cause the pin 26 to be urged by the socket 42 toward the center thereof. The upper 12 will, therefore, be displaced or moved in a horizontal direction, as indicated by the arrow 52 in FIG. 6, relative to the stationary carrier 14. The pin and socket will now be aligned and will result, because there are four of these pins and sockets, in the upper 12 being aligned, within acceptable tolerances, to permit rejoining of the upper and carrier. The jacks 22 are then extended just enough to permit removal of retaining pin 40 from the bores 36 and 38. The jacks 22 are then retracted fully to redeck the upper on the carrier. The centering pin 26 is then manually raised by the handle 34 to permit the retaining pin 40 to be inserted through bore 38 below the cap 32 to retain the pin 26 in its stowed position. Swinging movement of the upper on the carrier is then possible.

Movement of the upper in a horizontal direction while supported on the legs 20 would normally impose large stresses on legs as well as other structural components of the upper. In order to prevent this, the floats 24, as shown in FIG. 7, are provided with a base 54 to which a bearing block 56 is secured. An upper bearing plate 58 rests upon and is movable relative to the block 56. Both of these bearing members have smooth mating surfaces and are lubricated to provide as small a friction force to movement under load as possible. A fabricated socket 60 is attached to the plate 58 and facilitates attachment to the rod end of the jack 22 by means of a removable pin 62. A retaining flange is attached to the periphery of the plate 58 and limits lateral movement of the plate 58 relative to the block 56. The float 54 is initially positioned as shown in FIG. 7 with the block 56 centered on the plate 58. This relationship is established by aligning the edges of a plate 66, on which the block 56 is centered and attached, forming a part of the fabricated base 54 with a flange 64 attached to plate 58. During the centering sequence illustrated in FIG. 6, the leg 20 and jack 22 will also be displaced or moved laterally. The bearing plate 58 and its attached members will be able to move laterally as shown in FIG. 8, to accommodate the movement of the upper 12. As shown in FIG. 9, the movement of the plate 58 is universal in a horizontal plane and within the limits determined by contact between the flange 64 and the block 56. Handles 70 and 72 secured to the plate 58 and the base 54 respectively facilitate transport and positioning thereof.

While a preferred embodiment of the present invention has been shown and described herein, it will be appreciated that various changes and modifications may be made therein without departing from the spirit of the invention as defined by the scope of the appended claims.

What is claimed is:

1. A centering means for the redecking of a crane having an upper supported on retractable legs above a carrier, the upper and carrier each including complementary swing components which must be substantially aligned to effect redecking, comprising:

a plurality of concave members attached to said carrier;

an equal number of vertical centering pins slidably carried by said upper, each centering pin having a convex end complementary with one of said concave members;

said concave members positioned on said carrier so that said swing components are substantially aligned when said convex ends are fully seated in the corresponding concave members;

latch means including a retaining pin for selectively holding said centering pins in one of an extended position, wherein said swing components on said upper and said carrier are vertically spaced when said convex ends are in contact with said concave members, and a retracted position, wherein said convex ends are vertically spaced from the concave members when said upper is fully decked on said carrier;

float means attached to each leg permitting lateral shifting of said upper relative to said carrier to allow full seating of said convex ends in said concave members as said legs are retracted with said latch means holding said centering pins in their extended position.

2. The invention according to claim 1, wherein each float comprises:

a base for contacting the ground;

a bearing block affixed to said base;

a bearing plate resting on and shiftable relative to said block; and means for attaching said jacks to said plate.

3. The invention according to claim 2, and further comprising:

limiting means for restricting the lateral movement of said plate relative to said block.

4. The invention according to claim 3, wherein said limiting means comprises a flange attached to and encircling said plate and engageable with said block.

* * * * *